US007232993B1

(12) United States Patent
Specht et al.

(10) Patent No.: US 7,232,993 B1
(45) Date of Patent: Jun. 19, 2007

(54) ION FRAGMENTATION PARAMETER SELECTION SYSTEMS AND METHODS

(75) Inventors: August Specht, Walnut Creek, CA (US); Gregory J. Wells, Fairfield, CA (US)

(73) Assignee: Varian, Inc., Palo Alto, CA (US)

( * ) Notice: Subject to any disclaimer, the term of this patent is extended or adjusted under 35 U.S.C. 154(b) by 12 days.

(21) Appl. No.: 11/317,854

(22) Filed: Dec. 23, 2005

(51) Int. Cl.
*H01J 49/42* (2006.01)

(52) U.S. Cl. ..... 250/292; 250/281; 250/282

(58) Field of Classification Search ..... 250/292, 250/290, 293, 281, 282
See application file for complete search history.

(56) References Cited

U.S. PATENT DOCUMENTS 6,124,591 A 9/2000 Schwartz et al.
7,102,129 B2 * 9/2006 Schwartz ..... 250/292

OTHER PUBLICATIONS

Article by March, Raymond E., entitled "An Introduction to Quadrupole Ion Trap Mass Spectrometry" published by Journal of Mass Spectrometry, vol. 32, 351-369 (1997).

Article by Nam, et al., entitled "GC-MS/MS Analysis of Benzo(a)pyrene by Ion Trap Tandem Mass Spectrometry", published by Bull. Korean Chem. Soc. 2002, vol. 23, No. 8, pp. 1097-1102.

* cited by examiner

*Primary Examiner*—Kiet T. Nguyen
(74) *Attorney, Agent, or Firm*—Bella Fishman Andrei Popovici

(57) ABSTRACT

In some embodiments, a tandem (MS/MS) mass spectrometry method includes selecting a collision-induced dissociation (CID) voltage amplitude and a q-parameter value for a quadrupole ion trap to optimize a daughter ion fragmentation process for a given parent ion mass-to-charge (m/z) ratio. The q and CID voltage values may be selected according to a look-up table and/or using approximate analytical expressions. The correspondence between m/z values and (q, CID) value pairs may be established by pre-measurement calibration. A fragmentation-optimized q value may be computed according to m/z, and a CID voltage value may be determined according to the computed q value. A user may also force q to another value, for example in order to facilitate trapping of a desired daughter ion mass range, and the controller computes a CID voltage value according to the forced q value.

20 Claims, 5 Drawing Sheets

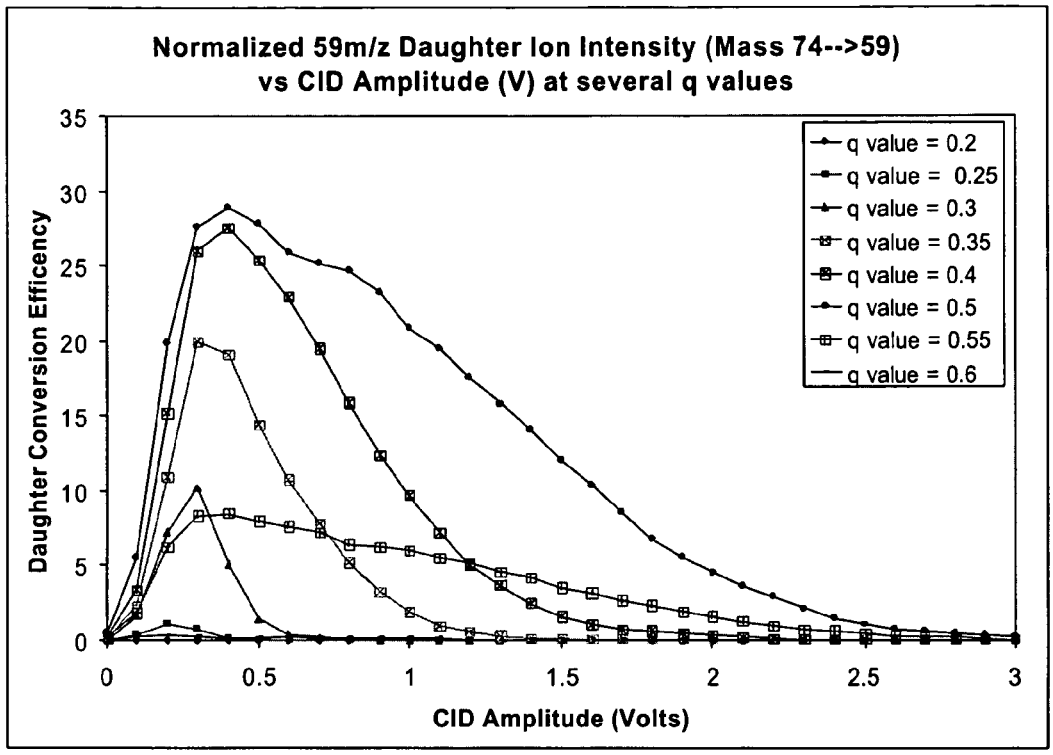
FIG. 3-A
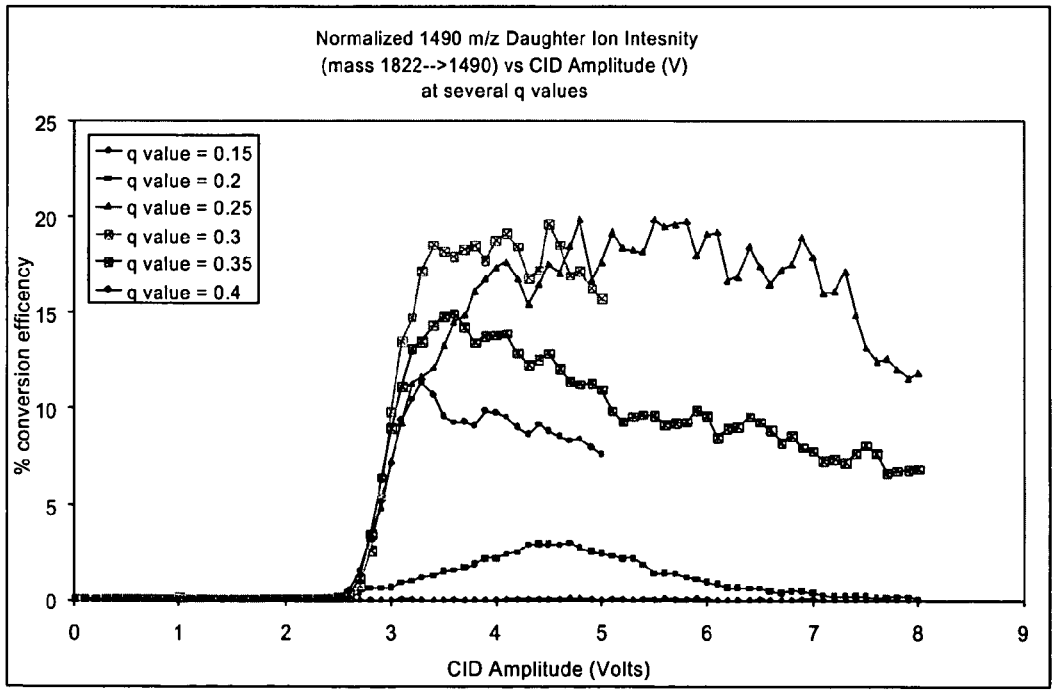
FIG. 3-B

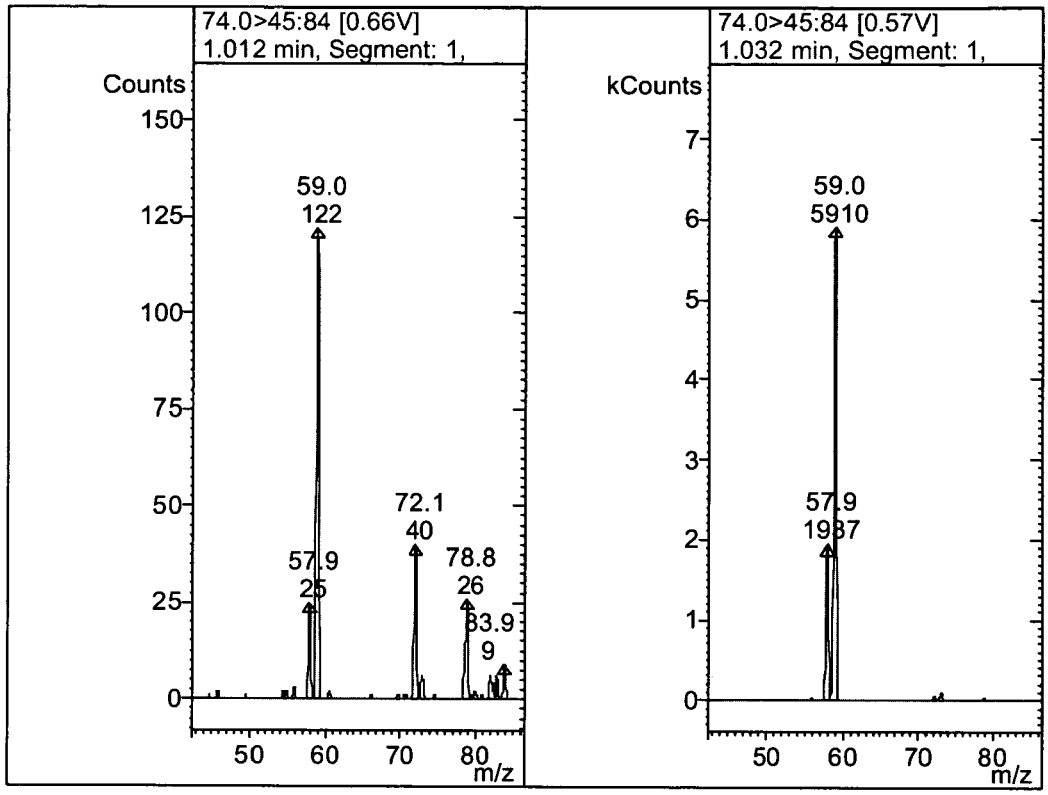
FIG. 6-A

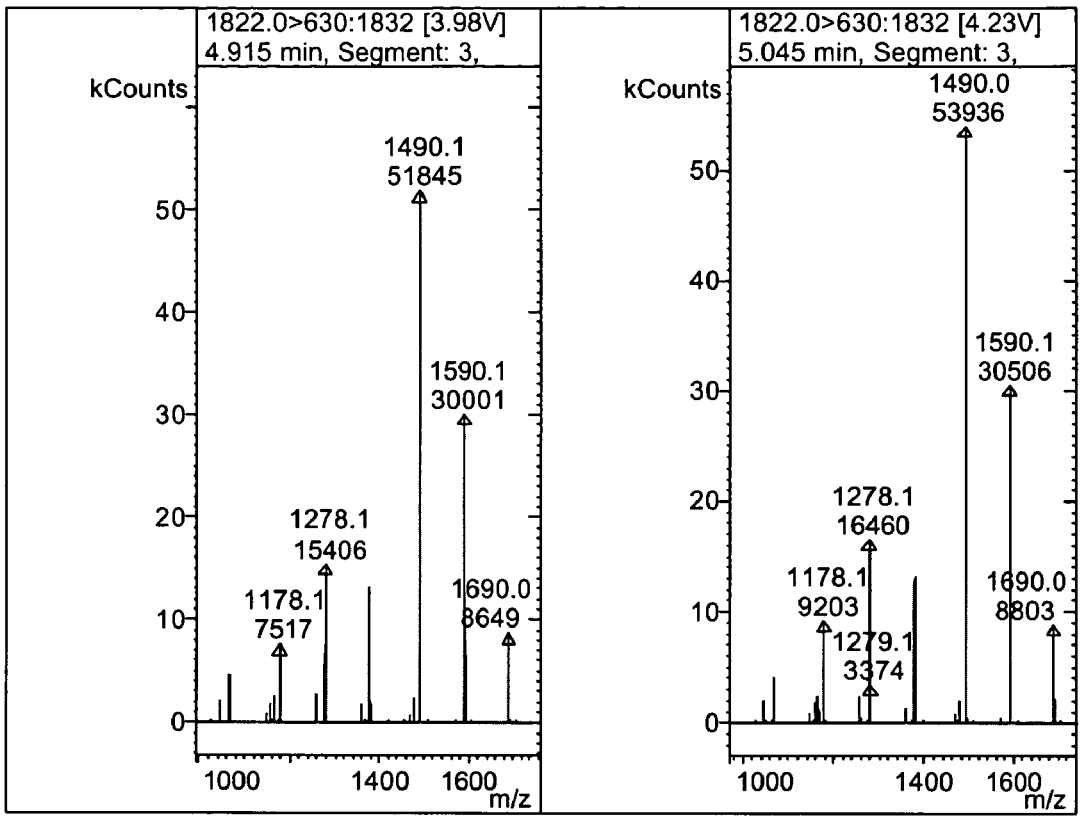
FIG. 6-B

ION FRAGMENTATION PARAMETER SELECTION SYSTEMS AND METHODS

BACKGROUND OF THE INVENTION

The invention relates to mass spectrometry, and in particular to methods of optimizing operating parameters of mass spectrometers.

In tandem mass spectrometry (MS/MS), a mass spectrometer is used to isolate an ion species of interest, selectively excite and fragment the isolated ions, and detect daughter ions resulting from the fragmentation. The fragmentation process, commonly achieved by collision-induced dissociation, or CID, may be performed by applying a dipolar sine wave across the endcaps of a quadrupole ion trap. The properties of an applied CID voltage waveform may affect the efficiency of the CID process.

In U.S. Pat. No. 6,124,591, Schwartz et al. describe a method of generating product ions in a quadrupole ion trap. The amplitude of the applied excitation voltage for an ion of a given mass-to-charge ratio (m/z) is linearly related to the mass-to-charge ratio.

SUMMARY OF THE INVENTION

According to one aspect, a mass spectrometry method comprises selecting a collision-induced-dissociation (CID) voltage amplitude according to a q parameter value for a parent ion; and inducing a fragmentation of the parent ion by applying a CID voltage having the CID voltage amplitude to an ion trap holding the parent ion.

According to another aspect, a mass spectrometry method comprises determining a q parameter value and a collision-induced dissociation (CID) voltage amplitude value according to a mass-to-charge ratio of a parent ion to optimize an efficiency of a fragmentation of the parent ion; and inducing the fragmentation of the parent ion according to the q parameter value and the CID voltage amplitude value.

According to another aspect, a mass spectrometry method comprises selecting a collision-induced-dissociation (CID) voltage amplitude for a parent ion according to a mass-to-charge ratio of a parent ion and an ion trap drive voltage indicator; and inducing a fragmentation of the parent ion according to the CID voltage amplitude and the ion trap drive voltage indicator.

According to another aspect, a mass spectrometry apparatus comprises a quadrupole ion trap including a central ring electrode and a pair of endcap electrodes disposed on opposite sides of the central ring electrode, and a mass spectrometer controller connected to the ion trap. The mass spectrometer controller is configured to select a collision-induced-dissociation (CID) voltage amplitude according to a q parameter value for a parent ion and a mass-to-charge ratio for the parent ion; trap the parent ion in the ion trap by applying a drive voltage according to the q parameter value to the central ring electrode; and while trapping the parent ion, induce a fragmentation of the parent ion by applying a CID voltage having the CID voltage amplitude across the endcap electrodes.

BRIEF DESCRIPTION OF THE DRAWINGS

The foregoing aspects and advantages of the present invention will become better understood upon reading the following detailed description and upon reference to the drawings where:

FIG. 3-A shows exemplary daughter ion intensity values as a function of CID voltage amplitude and q parameter values for a mass 74 to mass 59 fragmentation process, according to some embodiments of the present invention.

FIG. 3-B shows exemplary daughter ion intensity values as a function of CID voltage amplitude and q parameter values for a mass 1822 to mass 1490 fragmentation process, according to some embodiments of the present invention.

FIG. 6-A shows measured daughter ion intensities for a parent ion mass of 74 and two applied CID voltage amplitudes, one computed for a constant q as a function solely of mass-to-charge ratio, and one computed according to optimized q value, according to some embodiments of the present invention.

FIG. 6-B shows measured daughter ion intensities for a parent ion mass of 1822 and two applied CID voltage amplitudes, one computed for a constant q as a function solely of mass-to-charge ratio, and one computed according to an optimized q value, according to some embodiments of the present invention.

DETAILED DESCRIPTION OF THE INVENTION

In the following description, a set of elements includes one or more elements. Any reference to an element is understood to encompass one or more elements. Unless otherwise stated, any recited electrical or mechanical connections can be direct connections or indirect connections through intermediary structures. It is understood that all references to parameters encompass references to indicators for the parameters.

The following description illustrates embodiments of the invention by way of example and not necessarily by way of limitation.

Figure 1:
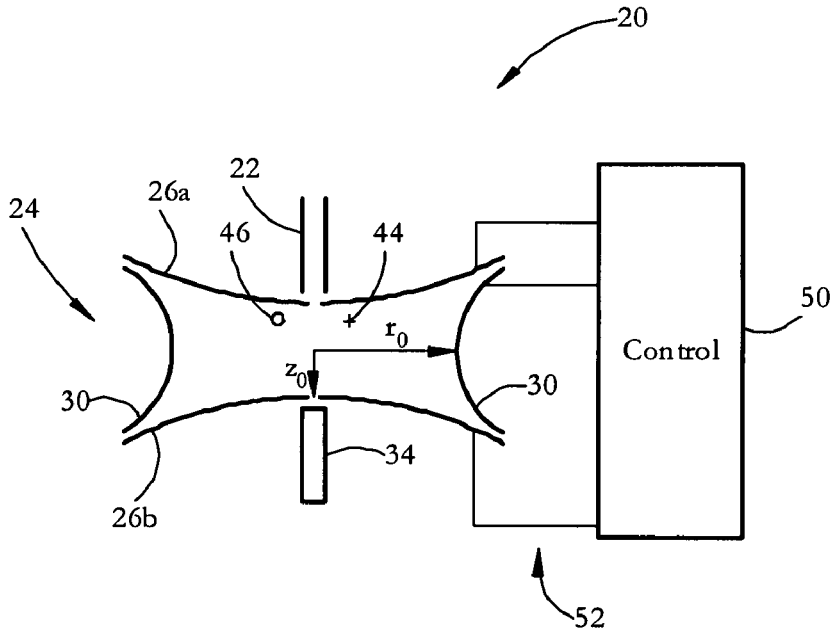
FIG. 1 is a schematic diagram of an exemplary mass spectrometry analysis apparatus according to some embodiments of the present invention.

FIG. 1 is a schematic diagram of an exemplary mass spectrometer 20 and associated control/optimization unit 50 according to some embodiments of the present invention. Spectrometer 20 includes a plurality of chambers and associated pumps, guiding components, and analysis components shown in FIG. 1. An ionization chamber (source) and a set of input ion guides, schematically shown at 22, are used to generate ions of interest and direct them to an quadrupole ion trap 24 forming an analysis chamber. The ions may be generated using an atmospheric pressure ionization method such as electrospray ionization (ESI) or atmospheric pressure chemical ionization (APCI), among others. Ion trap 24 holds an inert damping gas 40 such as Helium, and ions of interest 44. An ion detector 34 detects ions of a given mass exiting ion trap 24. Ion trap 24 includes a ring electrode 30 and a pair of endcap electrodes 26*a–b* positioned on opposite sides of ring electrode 30. Ring electrode 30 has an inner radius $r_0$. Each endcap electrode 26*a–b* is separated from the trap center by a distance $z_0$.

The electrodes of ion trap 24 are electrically connected to a control unit 50. Control unit 50 includes voltage generating circuitry for applying a set of RF/DC voltages as described below, as well as a programmed general-purpose computer controlling the magnitudes, frequencies, and durations of the applied voltages. Control unit 50 is also connected to detector 34, and receives measurement data for display to a user. Control unit 50 applies an RF drive (trap) voltage $V_{drive}$ to ring electrode 30, and an RF CID voltage $V_{CID}$ across endcap electrodes 26*a–d*. The frequencies and amplitudes of the voltages depend on the instrument and ions of interest. In exemplary embodiments, drive voltages $V_{drive}$ have frequencies on the order of hundreds of kHz to MHz, e.g. about 1 MHz, and amplitudes on the order of tens to thousands of Volts, e.g. 50–7,000 V, while CID voltages $V_{CID}$ have frequencies on the order of tens to hundreds of kHz, e.g. about 240 kHz, and amplitudes on the order of Volts to tens of Volts, e.g. 0–7 V.

Figure 2:
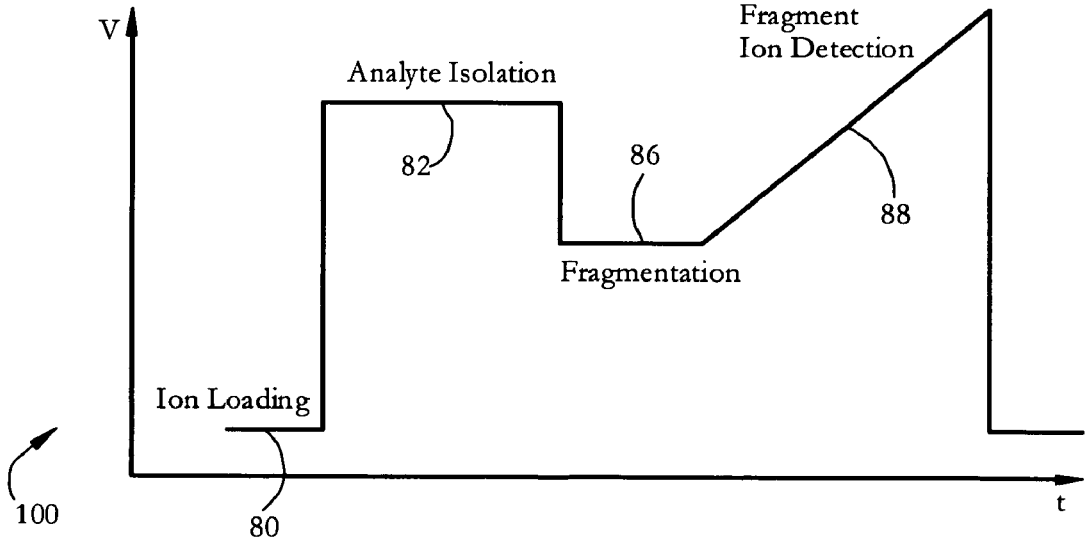
FIG. 2 shows a simplified exemplary voltage amplitude sequence illustrating an MS/MS process according to some embodiments of the present invention.

FIG. 2 shows a simplified exemplary drive voltage amplitude sequence 100 illustrating an MS/MS process according to some embodiments of the present invention. The drive voltage amplitude is held at a relatively low level during an ion loading 80, and raised to a higher amplitude during an analyte isolation 82. After an ion of interest is isolated within ion trap 24, an ion fragmentation 86 is performed by applying a CID voltage across endcap electrodes 26*a–b*, while the drive voltage is set to a desired level as described below. The drive voltage is ramped up to perform a fragment ion detection 88.

Detected fragment ion signals depend on the efficiency of the ion fragmentation process. The ion fragmentation process depends on collision-induced dissociation driven by the CID voltage applied across endcap electrodes 26*a–b*. The CID frequency is chosen to be nominally in resonance with the axial motion of the analyte ion within ion trap 24. The CID voltage has the net effect of increasing the instantaneous kinetic energy of the ions of interest. The ions of interest collide with the surrounding damping gas, and fragment into daughter ions as a result. The efficiency of the fragmentation process may be the limiting factor determining the detection limit for a daughter ion analyte.

The efficiency of the fragmentation process depends on a number of factors, including the pressure of the damping gas, the amplitude and duration of the CID voltage, and on properties of the analyte, ion trap and drive voltage. A relationship between the properties of the analyte, the ion trap and the drive voltage can be defined by the q parameter, which is a dimensionless parameter indicating whether a given analyte is stably trapped in the ion trap:

$$q = \frac{-8zV_{drive}}{m(r_0^2 + 2z_0^2)\Omega^2}, \quad [1]$$

wherein m is the mass of the analyte, z is the charge of the analyte, $r_0$ and $z_0$ are the trap dimensions shown in FIG. 1, and $V_{drive}$ and Ω are the amplitude and frequency, respectively, of the drive voltage. The parameter q reflects the amplitude of an RF restoring force applied to the analyte ions, and thus the instantaneous kinetic energy imparted to the ions. The parameter q and a parameter a, which depends on a DC voltage U applied to ring 30, may be used to define a stability region in a (q, a) plane; a given ion is stably trapped if its corresponding q and a values are within defined bounds in the (q, a) plane. Typical useful q values are between 0.1 and 0.9.

In some embodiments, CID amplitude and q parameter values are set to optimize daughter ion signals, as described in detail below. In particular, for a given m/z ratio, q parameter and CID amplitude values are chosen according to a predetermined table or analytical expression, and ion fragmentation is performed according to the selected values. The table or analytical expression are predetermined for a given instrument, and are implemented by control unit 50.

A detailed study was performed to analyze detected daughter ion intensities for a particular mass-to-charge (m/z) ratio and varying values of CID amplitude and q parameter. The data was collected by examining the relationship between daughter ion intensity and CID amplitude for a number of q values.

FIG. 3-A shows exemplary daughter ion intensity values as a function of CID voltage amplitude and q parameter values for a m/z 74 to m/z 59 fragmentation process, according to some embodiments of the present invention. The data were recorded using a Varian Inc. 500-MS ion trap mass spectrometer. The data of FIG. 3-A show that an optimal daughter ion conversion efficiency of 29% occurred for a selected q value of 0.5 and a CID voltage amplitude of 0.4 V. FIG. 3-B shows exemplary daughter ion intensity values as a function of CID voltage amplitude and q parameter values for a m/z 1822 to m/z 1490.1 fragmentation process, according to some embodiments of the present invention. An optimal daughter ion conversion efficiency of 20% occurred for a selected q value of 0.25 and a CID voltage amplitude of 4.8 V. The data of FIGS. 3-A–B show that optimal q and CID amplitude values may vary significantly as a function of parent ion mass.

Predetermined relationships between ion m/z and corresponding optimal q and CID amplitude values are preferably generated in an initialization/calibration process, and are stored by control unit 50. Following user entry of a given m/z ratio, control unit 50 retrieves stored values of q and CID amplitude, and controls the ion fragmentation process accordingly. The optimal values may be stored in one or more look-up tables or as a set of analytical relationships, as described below.

It was experimentally determined that, for an exemplary Varian Inc. 500-MS ion trap spectrometer, an optimal q value can be related to parent ion mass by the relation:

$$q = 2.98M^{-0.417} + (7.69e-5)M \quad [2]$$

wherein M=m/z is the mass-to-charge ratio with the mass expressed in daltons. Predictive relations similar to eq. [2] may be determined empirically for other instruments, for example for instruments using different ion trap designs.

Figure 4:
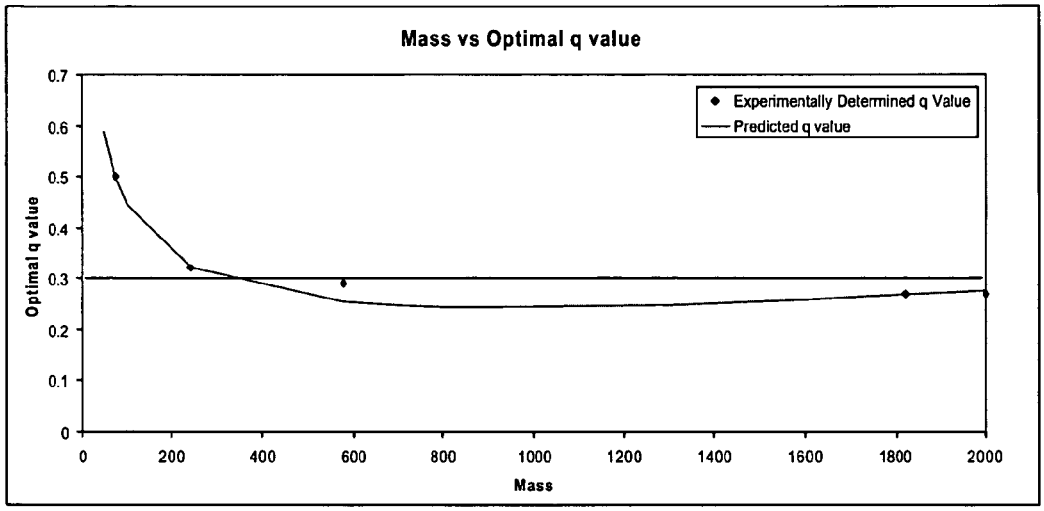
FIG. 4 shows experimentally-measured and predicted dependences of an optimal q value on ion mass, according to some embodiments of the present invention.

In some embodiments, a predictive equation such as eq. [2] is used to generate an optimal q value from a user-entered parent mass value m. A correspondence between m and q values may also be established by a look-up table. FIG. 4 shows a comparison between experimentally-measured and predicted dependences of an optimal q value on ion mass, according to some embodiments of the present invention. The predicted data was generated according to eq. [2]. FIG. 4 also show a horizontal line corresponding to a constant q value of 0.3. As shown, the dependence of optimal q on parent ion mass is particularly steep for relatively low parent ion mass values.

A relationship between an optimal CID amplitude and m and q values may be difficult to express analytically, and may be approximated as a power series. Eq. [3] shows an empirically-determined expression for $V_{cid}$ as a function of M and q:

$$V_{cid} = 0.2 + 0.00375M - 0.0644q - (2.82e-7)M^2 - 0.0142q^2 - 0.0038Mq + 30\frac{q}{M} \quad [3]$$

The constants in eq. [3] were determined empirically for an exemplary Varian Inc. 500-MS ion trap spectrometer. Other constants may be determined empirically for other instruments.

Figure 5:
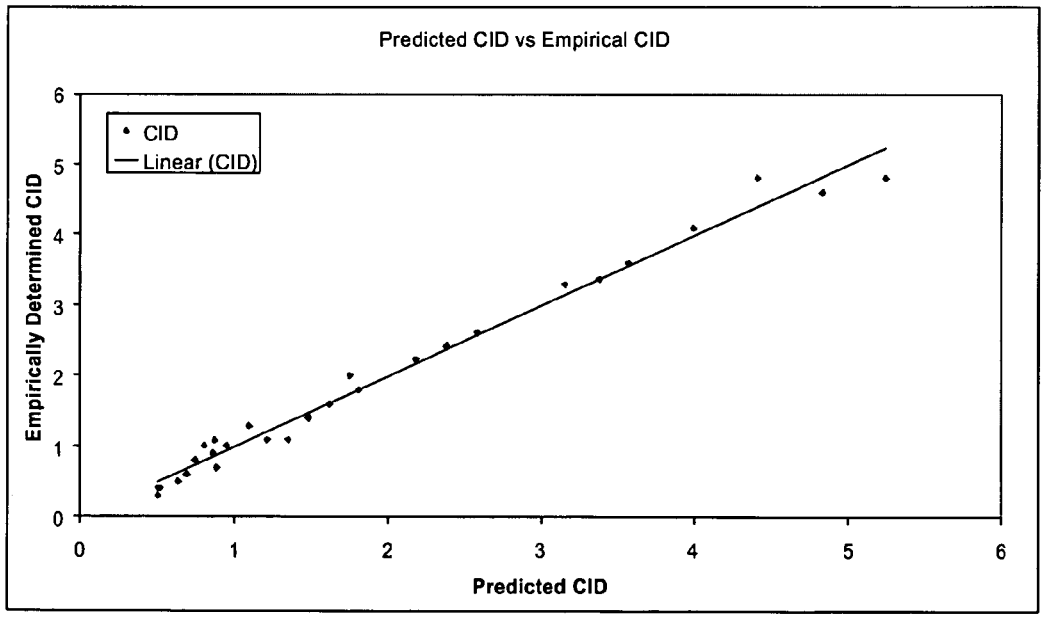
FIG. 5 illustrates an exemplary relationship between measured and predicted optimized CID voltages according to some embodiments of the present invention.

In some embodiments, a predictive equation such as eq. [3] is used to generate a $V_{cid}$ value for a user-entered m value and a q value determined as described above. A correspondence between $V_{cid}$ and m and q values may also be established by a look-up table. FIG. 5 shows a comparison between measured and predicted optimized CID voltages according to some embodiments of the present invention. The predicted data was generated according to eq. [3]. The line of FIG. 5 corresponds to an exact match between predicted and measured data.

In some embodiments, a user may force a different q value than an system-generated q value. Eq. [3] or a corresponding look-up table may then be used to generate a CID voltage amplitude using the provided m and q values. Forcing q to a particular value may be desirable in order to ensure a particular mass range is trapped. For example, a user wishing to look at a relatively low mass range may wish to force q lower than suggested by eq. [2].

A q-dependent CID voltage selection method as described above was compared with a q-independent method in which a CID voltage is selected as a linear function of mass-to-charge values. The comparison was performed for parent ion masses of 74 and 1822. FIGS. 6-A–B show the results of the comparisons.

FIG. 6-A shows measured daughter ion intensities for a parent ion m/z of 74 and two applied CID voltage amplitudes, one computed as a function solely of mass-to-charge ratio with a pre-set, mass-independent constant q, and one computed according to an optimized q value as described above. FIG. 6-B shows corresponding measured daughter ion intensities for a parent ion m/z of 1822. The left panels in FIGS. 6-A–B show data taken with a pre-set q of 0.3, which is a common value used for CID. For the pre-set q data in the left panels of FIGS. 6-A–B, the applied CID voltage was computed according to a relation:

$$V_{CID}=0.0019M+0.5134. \quad [4]$$

Tables 1-A and 1-B show q, CID and fragment intensity improvement data corresponding to FIGS. 6-A and 6-B respectively:

TABLE 1-A

| 74 m/z → Fragment at 59 m/z | CID selected according to eq. [4], pre-set q | CID selected according to q | % Improvement in Fragment Intensity |
|---|---|---|---|
| Suggested q value | 0.3 | 0.5 | |
| Suggested CID amplitude | 0.65 | 0.56 | |
| Fragment Ion Intensity | 122 | 5910 | 4744% |

TABLE 1-B

| 1822 m/z → Fragment at 1490 m/z | CID selected according to eq. [4], pre-set q | CID selected according to q | % Improvement in Fragment Intensity |
|---|---|---|---|
| Suggested q value | 0.3 | 0.27 | |
| Suggested CID amplitude | 3.97 | 4.23 | |
| Fragment Ion Intensity | 51845 | 53936 | 4% |

For the data of Table 1-A and FIG. 6-A, the improvement in detected fragment ion intensity resulting from using optimized q and CID values as described above was over 40-fold, relative to an approach using a pre-set q value of 0.3. For the data of Table 1-B and FIG. 6-B, the improvement was about 4%, in part because the pre-set q value of 0.3 was relatively close to the optimized q value of 0.27.

Using both parent ion mass (or mass-to-charge ratio) and q parameter values to optimize CID parameters such as the CID voltage amplitude reflects an observation that the CID process is affected by ion stability (reflected in the parent ion mass), as well as the ion excitation process (reflected by the q parameter). Ion stability depends on the mass and chemical structure of the parent ion. Generally, parent ions having larger masses tend to have higher numbers of chemical bonds; if collision energy is distributed between multiple bonds, higher number of bonds generally means that higher collision energies are required to break a given bond. The energy resulting from collisions between ions and a surrounding charge-neutral gas (e.g. Helium) depends on the trap geometry and voltage. The relationship between collision energy and trap geometry and voltage may be relatively complex and difficult to characterize. Empirically-determined calibration data, stored as a table or a set of analytical expressions, may be particularly suited for setting CID voltages according to trap electrical parameters.

Eq. [1] above shows the relationship between q and the trap voltage for a given parent ion mass-to-charge ratio and trap voltage frequency. In some embodiments, a trap voltage may be used as an indicator of a q parameter value. Similarly, other proxies for q may be used as indicators of q parameter values.

The above embodiments may be altered in many ways without departing from the scope of the invention. Accordingly, the scope of the invention should be determined by the following claims and their legal equivalents.

What is claimed is:

1. A mass spectrometry method comprising:

selecting a collision-induced-dissociation (CID) voltage amplitude according to a q parameter value for a parent ion; and inducing a fragmentation of the parent ion by applying a CID voltage having the CID voltage amplitude to an ion trap holding the parent ion.

2. The method of claim 1, further comprising trapping the parent ion according to the q parameter value while inducing the fragmentation of the parent ion.

3. The method of claim 1, comprising selecting the CID voltage amplitude according to a mass-to-charge ratio of the parent ion.

4. The method of claim 1, further comprising selecting the q parameter value according to a mass-to-charge ratio of the parent ion to optimize an efficiency of the fragmentation of the parent ion.

5. The method of claim 1, further comprising receiving a user selection of the q parameter value.

6. The method of claim 1, wherein selecting the CID voltage amplitude comprises employing a table establishing a correspondence between parent ion mass-to-charge ratios, corresponding fragmentation-optimized q parameter values and CID voltage amplitudes.

7. The method of claim 1, wherein selecting the CID voltage amplitude comprises employing an analytical expression establishing a dependence of the CID voltage amplitude on the q parameter value and a mass-to-charge ratio of the parent ion.

8. The method of claim 1, further comprising performing a set of calibration measurements establishing a dependence of a set of fragmentation-optimized q parameter values and CID voltage amplitudes on a set of corresponding parent ion mass-to-charge ratios.

9. The method of claim 1, further comprising detecting a daughter ion resulting from the fragmentation of the parent ion.

10. A mass spectrometry method comprising:

from a mass-to-charge ratio of a parent ion, determining a q parameter value and a collision-induced dissociation (CID) voltage amplitude to optimize an efficiency of a fragmentation of the parent ion; and inducing the fragmentation of the parent ion according to the q parameter value and the CID voltage amplitude.

11. A mass spectrometry method comprising:

selecting a collision-induced-dissociation (CID) voltage amplitude for a parent ion according to a mass-to-charge ratio of the parent ion and an ion trap drive voltage indicator; and inducing a fragmentation of the parent ion in the ion trap according to the CID voltage amplitude and the ion trap drive voltage indicator.

12. The method of claim 11, wherein the ion trap drive voltage indicator comprises a q parameter value.

13. The method of claim 11, wherein the ion trap drive voltage indicator comprises a drive voltage amplitude.

14. A mass spectrometry apparatus comprising:

a quadrupole ion trap including a central ring electrode and a pair of endcap electrodes disposed on opposite sides of the central ring electrode; and a mass spectrometer controller connected to the ion trap and configured to:

select a collision-induced-dissociation (CID) voltage amplitude according to a q parameter value for a parent ion and a mass-to-charge ratio of the parent ion;

trap the parent ion in the ion trap by applying a drive voltage according to the q parameter value to the central ring electrode; and while trapping the parent ion, induce a fragmentation of the parent ion by applying a CID voltage having the CID voltage amplitude across the endcap electrodes.

15. The apparatus of claim 14, wherein the controller is configured to select the q parameter value according to the mass-to-charge ratio of the parent ion to optimize an efficiency of the fragmentation of the parent ion.

16. The apparatus of claim 14, wherein the controller is configured to receive a user selection of the q parameter value.

17. The apparatus of claim 14, wherein the controller is configured to selecting the CID voltage amplitude by employing a table establishing a correspondence between parent ion mass-to-charge ratios, corresponding fragmentation-optimized q parameter values and CID voltage amplitudes.

18. The apparatus of claim 14, wherein the controller is configured to select the CID voltage amplitude by employing an analytical expression establishing a dependence of the CID voltage amplitude on the q parameter value and the mass-to-charge ratio of the parent ion.

19. The apparatus of claim 14, wherein the controller is configured to perform a set of calibration measurements establishing a dependence of a set of fragmentation-optimized q parameter values and CID voltage amplitudes on a set of corresponding parent ion mass-to-charge ratios.

20. The apparatus of claim 14, further comprising a detector connected to the ion trap and configured to detect a daughter ion resulting from the fragmentation of the parent ion.

* * * * *